US009291166B2

(12) United States Patent
De Larminat et al.

(10) Patent No.: US 9,291,166 B2
(45) Date of Patent: Mar. 22, 2016

(54) MOTOR COOLING SYSTEM

(75) Inventors: Paul De Larminat, Nantes (FR); Damien Jean Daniel Arnou, La Séguinière (FR)

(73) Assignee: Johnson Controls Technology Company, Holland, MI (US)

( * ) Notice: Subject to any disclaimer, the term of this patent is extended or adjusted under 35 U.S.C. 154(b) by 236 days.

(21) Appl. No.: 13/880,465

(22) PCT Filed: Dec. 12, 2011

(86) PCT No.: PCT/US2011/064359

§ 371 (c)(1), (2), (4) Date: May 22, 2013

(87) PCT Pub. No.: WO2012/082592

PCT Pub. Date: Jun. 21, 2012

(65) Prior Publication Data

US 2013/0230382 A1 Sep. 5, 2013

Related U.S. Application Data

(60) Provisional application No. 61/423,637, filed on Dec. 16, 2010.

(51) Int. Cl.

| | |
|---|---|
| ***F25B 39/02*** | (2006.01) |
| ***F04D 15/00*** | (2006.01) |
| ***F04D 25/08*** | (2006.01) |
| ***F04D 29/58*** | (2006.01) |

(52) U.S. Cl.

CPC ..... *F04D 15/00* (2013.01); *F04D 25/082* (2013.01); *F04D 29/584* (2013.01)

(58) Field of Classification Search

CPC .... F04D 29/063; F25B 31/006; F25B 31/008; F25B 1/10; F25B 13/00; F25B 43/02; F25B 39/04

USPC ..... 62/84, 470, 498, 505, 508, 511, 519; 415/175

See application file for complete search history.

(56) References Cited

U.S. PATENT DOCUMENTS

| | | | | |
|---|---|---|---|---|
| 2,891,391 | A * | 6/1959 | Grant et al. | 62/475 |
| 3,422,635 | A * | 1/1969 | Trenkowitz | 62/469 |
| 4,573,324 | A | 3/1986 | Tischer et al. | |
| 5,350,039 | A * | 9/1994 | Voss et al. | 184/6.16 |

(Continued)

FOREIGN PATENT DOCUMENTS

JP 10292948 A 11/1998

*Primary Examiner* — Melvin Jones

(74) *Attorney, Agent, or Firm* — McNees Wallace & Nurick LLC

(57) ABSTRACT

A cooling system provided for a motor powering a compressor in a vapor compression system. The cooling system includes a housing enclosing the motor and a cavity located within the housing. A fluid circuit has a first connection with the housing configured to provide a liquid or two phase cooling fluid to the motor. The two phase cooling fluid is separable into a vapor phase portion and a liquid phase portion. The fluid circuit further has a second connection with the housing to remove cooling fluid in fluid communication with the fluid circuit. The cooling fluid conveyed through the second connection is two phase cooling fluid. The fluid circuit further has a third connection with the housing for receiving and circulating in the cavity the vapor phase portion conveyed through the second connection.

11 Claims, 10 Drawing Sheets

(56) References Cited

U.S. PATENT DOCUMENTS 6,065,297 A * 5/2000 Tischer et al. ..... 62/84
6,070,421 A 6/2000 Petrovich et al.
6,375,438 B1 4/2002 Seo
6,450,781 B1 * 9/2002 Petrovich et al. ..... 417/350
7,181,928 B2 2/2007 de Larminat

* cited by examiner

MOTOR COOLING SYSTEM

CROSS-REFERENCE TO RELATED APPLICATIONS

This application claims priority from and the benefit of U.S. Provisional Patent Application No. 61/423,637, filed Dec. 16, 2010, entitled "MOTOR COOLING SYSTEM", which is hereby incorporated by reference.

BACKGROUND

This application relates generally to the cooling of motors for vapor compression systems incorporated in air conditioning and refrigeration applications. More specifically, this application relates to cooling semi-hermetic motors for vapor compression systems.

Vapor compression systems can use more compact motors operating at higher rotational speeds to provide power to components. By using more compact motors, a reduction in the size of the systems can be obtained. However, some challenges associated with operating motors at higher rotational speeds include the generation of friction between the motor shaft and bearings and windage losses. Windage is a frictional force created between the rotating rotor of the motor and the environment surrounding the rotor, typically air or a working media, such as refrigerant vapor in the case of a hermetic driveline. Windage can create heat and reduce the operational efficiency of the motor. Therefore, effective cooling of these motors is highly desirable.

Cooling of a motor stator may be achieved by use of a cooling coil surrounding the stator, the coil receiving liquid refrigerant from a condenser of a vapor compression system. The coil is typically integrated in the stator housing. Due to contact with the warm surfaces of the stator and its housing, the refrigerant evaporates in this coil and cools the stator. An example is disclosed in U.S. Pat. No. 6,070,421. In addition, a similar refrigerant circuit can also be used to cool electronic components used for the variable speed drive (VSD), bearing electronics, when such components are disposed on the motor housing that can be a "cold plate" for these components.

Motor components that are not in sufficiently close proximity with the motor housing (motor windings, bearings, etc.) require other cooling arrangements. As in traditional semi-hermetic motors, a known approach is to sweep or direct cold vapor or gas through the motor cavity. However, particular arrangements of components must be provided to supply and circulate the cold gas in the motor. In one traditional semi-hermetic motor, part or all of the gas provided to compressor suction is provided to pass over or through the motor cavity prior to reaching compressor suction.

A further cooling arrangement is disclosed in U.S. Pat. No. 7,181,928, in which some cold gas is taken from the evaporator and drawn into the compressor suction. The pressure difference required to move the gas through the motor cavity is provided by the venturi effect that is produced at the inlet of the impeller of a centrifugal compressor.

In a further arrangement, cold gas evaporated in a coil surrounding the stator is used to cool the motor cavity. In this arrangement, a control device is used with respect to the supply of liquid refrigerant to the coil, so that all of the liquid is evaporated at the coil outlet. This control device can be a thermal expansion valve similar to those used in conjunction with "Dry-expansion" evaporators, or a more or less equivalent system (e.g., a combination of solenoid valves controlled by a temperature sensor, etc.) to avoid sending liquid into the motor.

U.S. Pat. No. 6,070,421 discloses a two stage system with an intercooler, in which the flash gas from the intercooler is used to sweep or to be directed through the motor housing. In addition, the gas evaporated in the coil surrounding the stator that is also directed through the housing is then vented at the inter stage pressure. As disclosed in the previous arrangement, an expansion valve is provided to ensure all of the liquid refrigerant is evaporated from the coil, as any remaining liquid could damage motor components.

While the systems as described provide viable results, the systems also have drawbacks.

For example, use of an expansion device at the inlet of a cooling coil to ensure all of the liquid refrigerant is evaporated from the coil also ensures pressure in the motor cavity self-adjusts to a level slightly above suction pressure or inter stage pressure, depending upon the application. The self-adjustment provides gas to be effectively directed through the cavity of the motor housing to cool the cavity. However, the system is not thermally optimized: complete evaporation of the refrigerant provides a reduction in heat transfer in the coil as compared to refrigerant at the coil outlet that is in a two phase state. Also, the gas refrigerant sent into the motor tends to be somewhat superheated, resulting in less efficient cooling in the motor cavity. In addition, in the system providing gas refrigerant at a level slightly above inter stage pressure, evaporation occurs at a higher temperature, which reduces the amount of cooling that can be provided. Operating the motor in gas at an increased internal pressure level also increases the amount of friction (and heat) generated by the gas refrigerant, undermining the initial purpose of cooling the motor.

U.S. Pat. No. 7,181,928 does not include a thermostatic expansion valve at the inlet of the stator cooling coil, containing only a fixed orifice sized such that the amount of liquid refrigerant directed into the cooling coil surrounding the stator is substantially larger than the amount that needs to be evaporated to reject the stator heat. This arrangement results in two phase flow at the coil outlet. Two phase flow of refrigerant improves the heat transfer in the coil, providing better cooling to the stator; but a consequence is that the two phase refrigerant flowing out of the coil cannot be sent directly into the motor. Introducing liquid refrigerant into a high speed motor presents the risk of damaging some components of the motor, e.g., by erosion generated by liquid droplets. In response to the risk of damage, the '928 patent discloses the two phase refrigerant exiting the coil is first sent back to the evaporator to separate the liquid from the gas; then some cold gas separated by the evaporator is returned to the motor cavity.

Additionally, while the '928 patent is well suited and proven for compressors without Pre-Rotation Vanes (PRV), or using a PRV for capacity reduction, an alternative to the PRV is to use a Variable Gap Diffuser (VGD) as a capacity reduction device. When a VGD is used for capacity reduction, the reduction of pressure at compressor suction at a partial load is not large enough to draw a satisfactory amount of gas refrigerant through the motor cavity, resulting in insufficient motor cooling.

Therefore, what is needed is a cooling arrangement allowing each of the following advantages to occur simultaneously:

- Accommodate a sufficiently large supply of liquid refrigerant to the coil surrounding the stator, to optimize the stator cooling by virtue of two phase flow out of the coil.
- Provide easy and efficient sweep or directed flow of cold gas or cooling vapor through the motor cavity.
- Prevent introduction of liquid refrigerant into the motor cavity.

Provide the possibility of venting of the vapor or gas refrigerant from the motor housing at or close to suction pressure to maintain reduced temperature vapor or gas directed through the motor cavity, as well as maintaining reduced vapor or gas friction losses.

SUMMARY

One embodiment of the present invention is directed to a cooling system provided for a motor powering a compressor in a vapor compression system. The cooling system includes a housing enclosing the motor and a cavity located within the housing. A fluid circuit having a first connection with the housing is configured to provide a liquid or two phase cooling fluid to the motor. The two phase cooling fluid is separable into a vapor phase portion and a liquid phase portion. The fluid circuit further has a second connection with the housing to remove cooling fluid in fluid communication with the fluid circuit. The cooling fluid conveyed through the second connection is two phase cooling fluid. The fluid circuit further has a third connection with the housing for receiving and circulating in the cavity the vapor phase portion conveyed through the second connection.

Another embodiment of the present invention is directed to a method for cooling a motor powering a compressor in a vapor compression system. The method includes providing a housing enclosing the motor and a cavity located within the housing. The method further includes providing a fluid circuit having a first connection with the housing configured to provide cooling fluid to the motor. The fluid circuit further has a second connection with the housing to remove cooling fluid in fluid communication with the fluid circuit. The fluid circuit further has a third connection with the housing for receiving cooling fluid in the cavity conveyed through the second connection. The method further includes separating cooling fluid flowing between the first connection and the second connection into a vapor phase portion and a liquid phase portion. The cooling fluid flowing between the first connection and the second connection is prevented from being circulated inside the housing to nonmoving components. The method further includes circulating in the cavity the vapor phase portion conveyed through the third connection.

Other features and advantages of the present invention will be apparent from the following more detailed description of the preferred embodiment, taken in conjunction with the accompanying drawings which illustrate, by way of example, the principles of the invention.

DETAILED DESCRIPTION OF EXEMPLARY EMBODIMENTS

Figure 1:
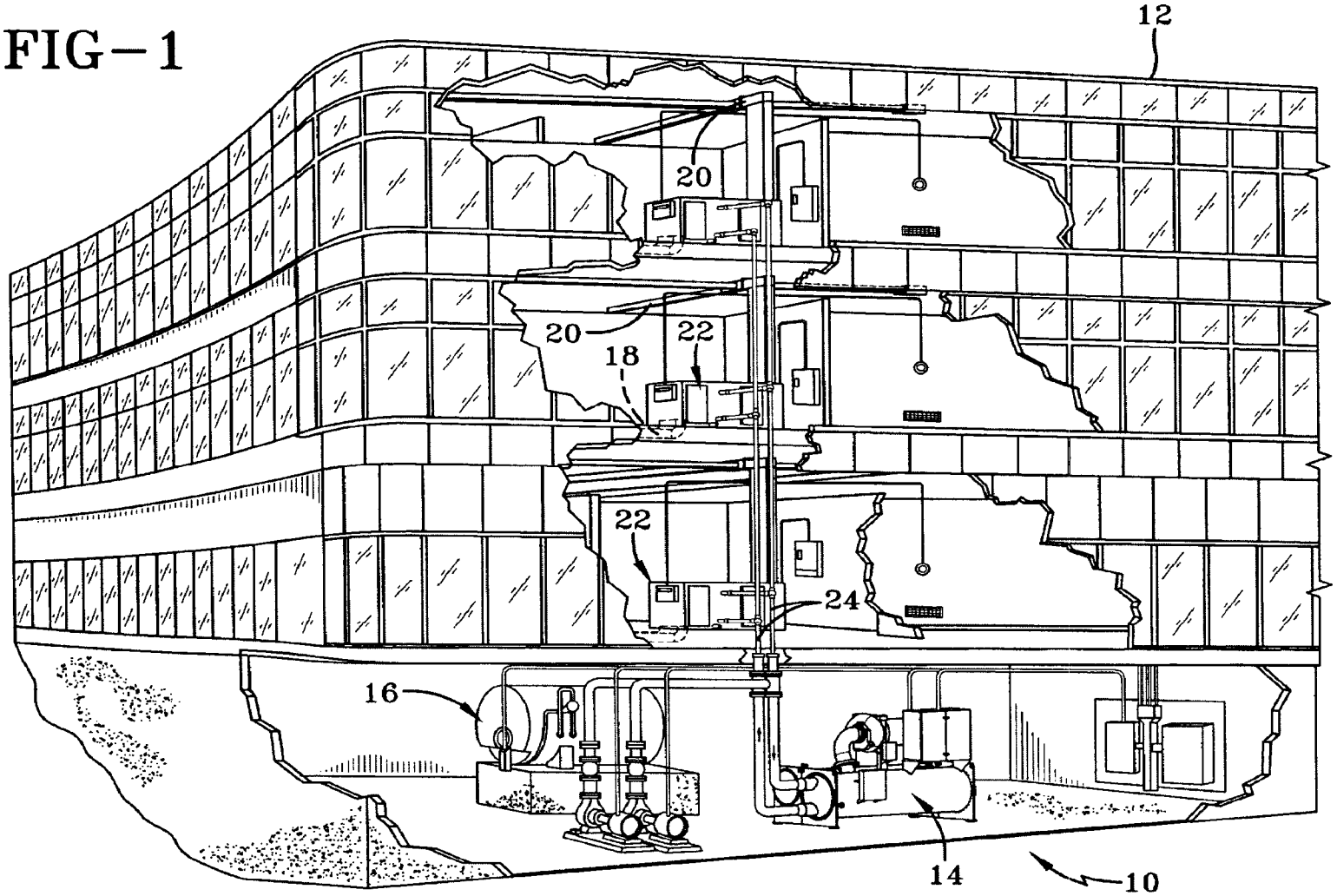
FIG. 1 shows an exemplary embodiment for a heating, ventilation and air conditioning system in a commercial setting.

FIG. 1 shows an exemplary environment for a heating, ventilation and air conditioning (HVAC) system 10 in a building 12 for a typical commercial setting. System 10 can include a vapor compression system 14 that can supply a chilled liquid which may be used to cool building 12. System 10 can include a boiler 16 to supply heated liquid that may be used to heat building 12, and an air distribution system which circulates air through building 12. The air distribution system can also include an air return duct 18, an air supply duct 20 and an air handler 22. Air handler 22 can include a heat exchanger that is connected to boiler 16 and vapor compression system 14 by conduits 24. The heat exchanger in air handler 22 may receive either heated liquid from boiler 16 or chilled liquid from vapor compression system 14, depending on the mode of operation of system 10. System 10 is shown with a separate air handler on each floor of building 12, but it is appreciated that the components may be shared between or among floors.

Figure 2:
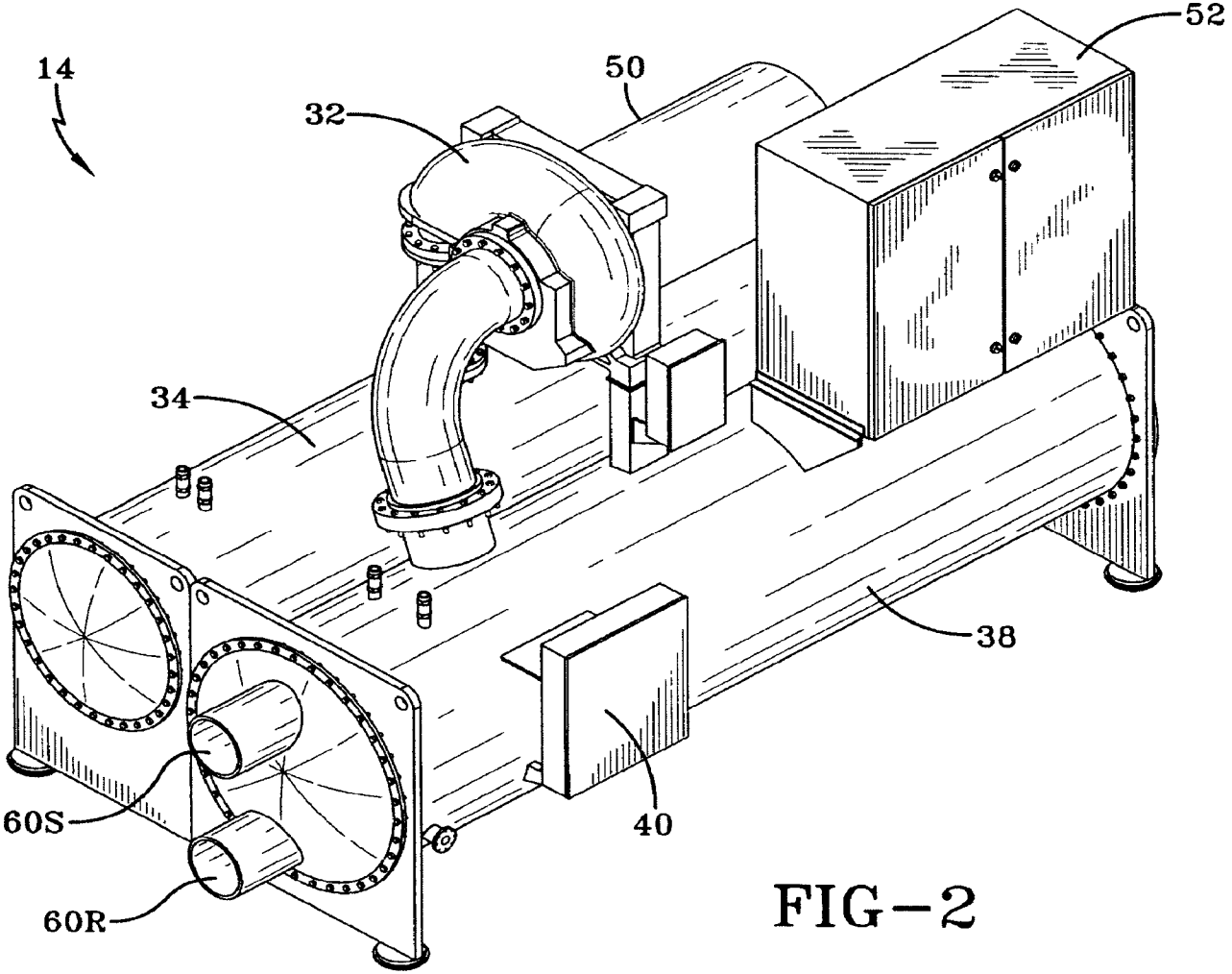
FIG. 2 shows an isometric view of an exemplary vapor compression system.
Figure 3:
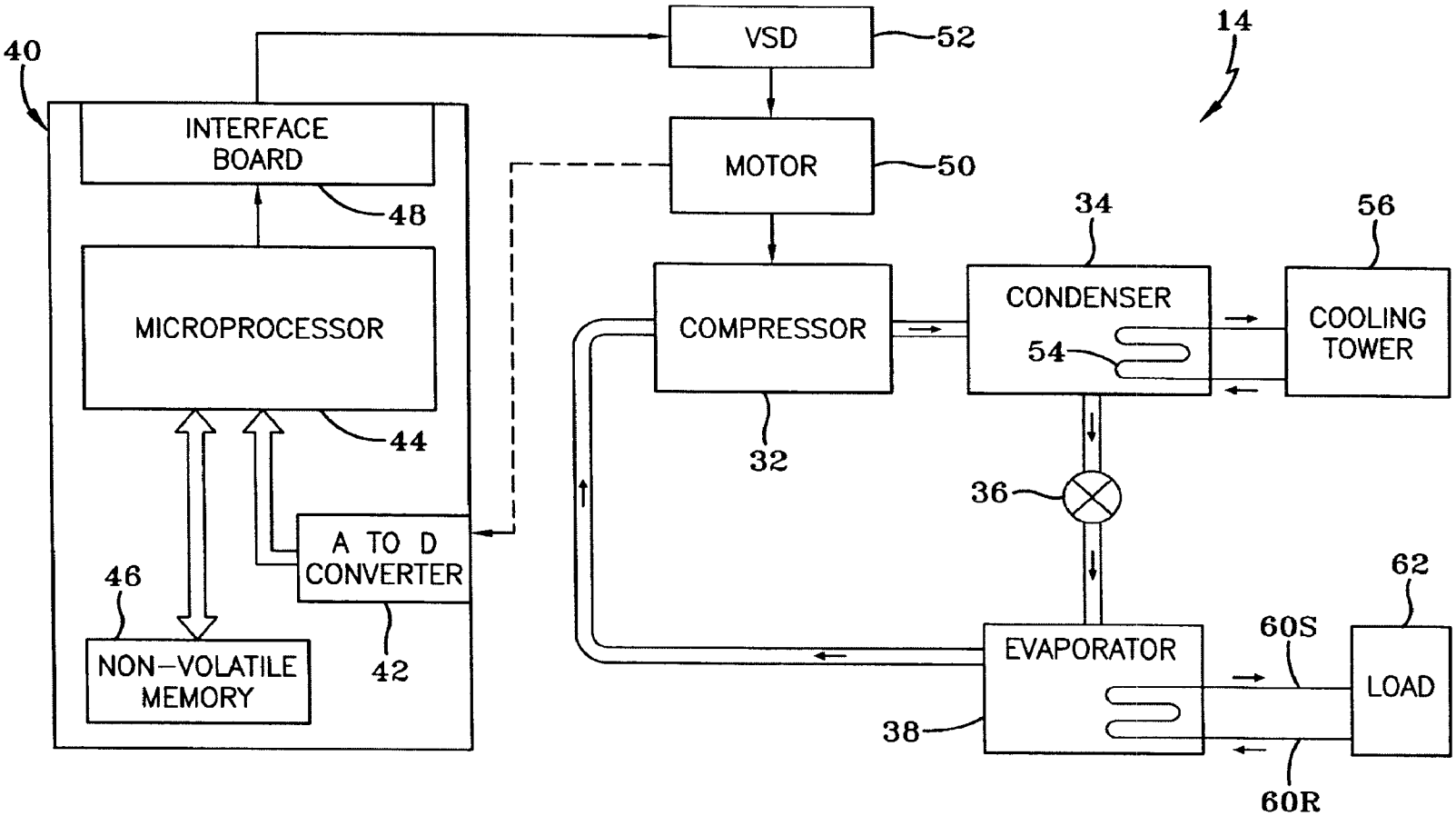
FIGS. 3 and 4 schematically illustrate exemplary embodiments of a vapor compression system.

FIGS. 2 and 3 show an exemplary vapor compression system 14 that can be used in HVAC system 10. Vapor compression system 14 can circulate a refrigerant through a circuit starting with compressor 32 and including a condenser 34, expansion valve(s) or device(s) 36, and a liquid chiller or an evaporator 38. Vapor compression system 14 can also include a control panel 40 that can include an analog to digital (A/D) converter 42, a microprocessor 44, a non-volatile memory 46, and an interface board 48. Some examples of fluids that may be used as refrigerants in vapor compression system 14 are hydrofluorocarbon (HFC) based refrigerants, for example, R-410A, R-407, R-134a, hydrofluoro olefin (HFO), "natural" refrigerants like ammonia ($NH_3$), R-717, carbon dioxide ($CO_2$), R-744, or hydrocarbon based refrigerants, water vapor or any other suitable type of refrigerant. In an exemplary embodiment, vapor compression system 14 may use one or more of each of variable speed drives (VSDs) 52, motors 50, compressors 32, condensers 34, expansion valves or devices 36 and/or evaporators 38.

Motor 50 used with compressor 32 can be powered by a variable speed drive (VSD) 52 or can be powered directly from an alternating current (AC) or direct current (DC) power source. VSD 52, if used, receives AC power having a particular fixed line voltage and fixed line frequency from the AC power source and provides power having a variable voltage and frequency to motor 50. Motor 50 can include any type of electric motor that can be powered by a VSD or directly from an AC or DC power source. Motor 50 can be any other suitable motor type, for example, a switched reluctance motor, an induction motor, or an electronically commutated permanent magnet motor.

Compressor 32 compresses a refrigerant vapor and delivers the vapor to condenser 34 through a discharge passage. Compressor 32 can be a centrifugal compressor in one exemplary embodiment. The refrigerant vapor delivered by compressor 32 to condenser 34 transfers heat to a fluid, for example, water or air. The refrigerant vapor condenses to a refrigerant liquid in condenser 34 as a result of the heat transfer with the fluid. The liquid refrigerant from condenser 34 flows through expansion device 36 to evaporator 38. In the exemplary embodiment shown in FIG. 3, condenser 34 is water cooled and includes a tube bundle 54 connected to a cooling tower 56.

The liquid refrigerant delivered to evaporator 38 absorbs heat from another fluid, which may or may not be the same type of fluid used for condenser 34, and undergoes a phase change to a refrigerant vapor. In the exemplary embodiment shown in FIG. 3, evaporator 38 includes a tube bundle having a supply line 60S and a return line 60R connected to a cooling load 62. A process fluid, for example, water, ethylene glycol, calcium chloride brine, sodium chloride brine, or any other suitable liquid, enters evaporator 38 via return line 60R and exits evaporator 38 via supply line 60S. Evaporator 38 chills the temperature of the process fluid in the tubes. The tube bundle in evaporator 38 can include a plurality of tubes and a plurality of tube bundles. The vapor refrigerant exits evaporator 38 and returns to compressor 32 by a suction line to complete the cycle.

Figure 4:
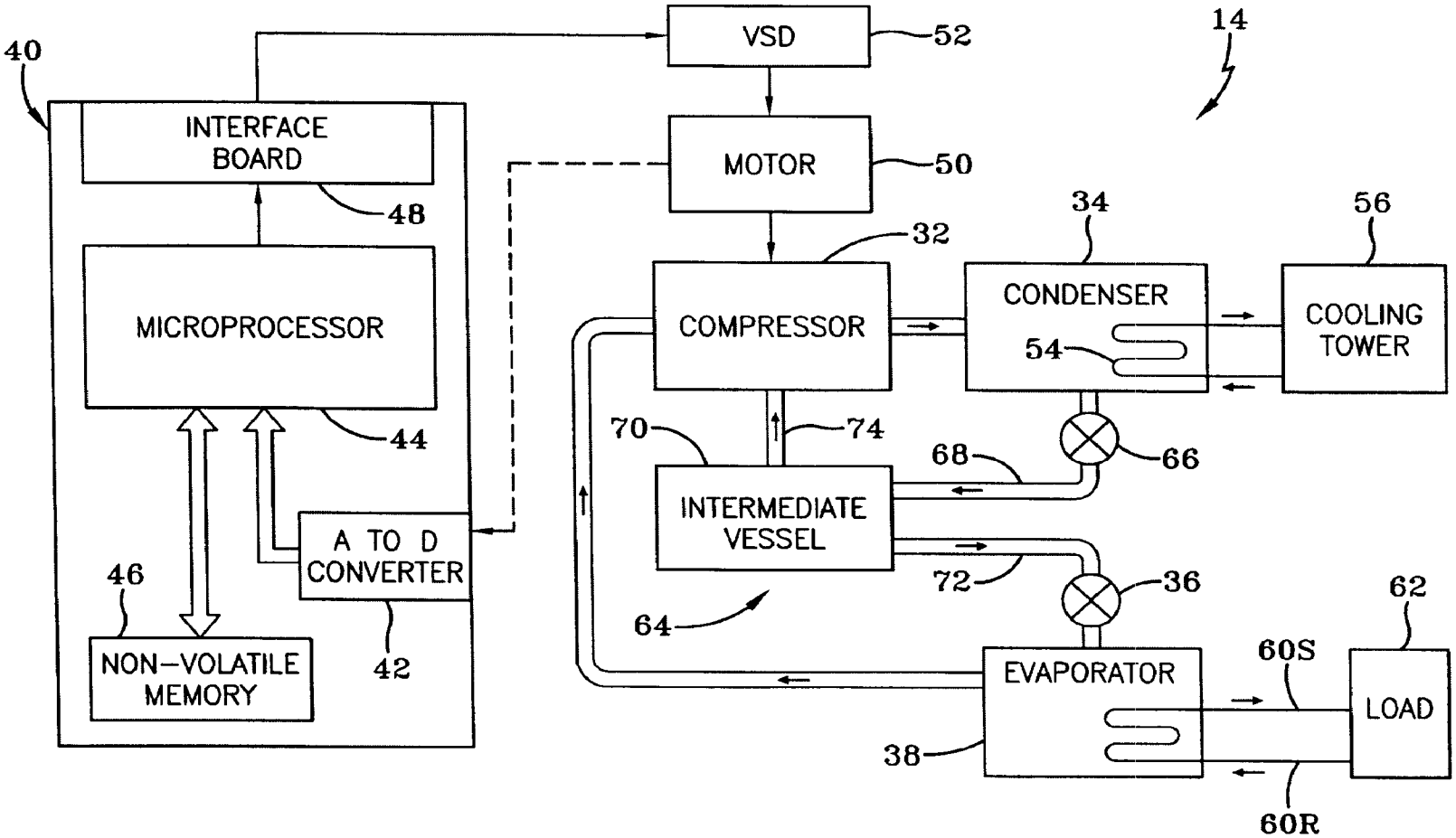

FIG. 4, which is similar to FIG. 3, shows the vapor compression system 14 with an intermediate circuit 64 incorporated between condenser 34 and expansion device 36. Intermediate circuit 64 has an inlet line 68 that can be either connected directly to or can be in fluid communication with condenser 34. As shown, inlet line 68 includes a first expansion device 66 positioned upstream of an intermediate vessel 70. Intermediate vessel 70 can be a flash tank, also referred to as a flash intercooler, in an exemplary embodiment. In an alternate exemplary embodiment, intermediate vessel 70 can be configured as a heat exchanger or a "surface economizer." In the configuration shown in FIG. 4, i.e., the intermediate vessel 70 is used as a flash tank, first expansion device 66 operates to lower the pressure of the liquid received from condenser 34. During the expansion process, a portion of the liquid vaporizes. Intermediate vessel 70 may be used to separate the vapor from the liquid received from first expansion device 66 and may also permit further expansion of the liquid. The vapor may be drawn by compressor 32 from intermediate vessel 70 through a line 74 to the suction inlet, or as shown in FIG. 4, to a port at a pressure intermediate between suction and discharge or an intermediate stage of compression. The liquid that collects in the intermediate vessel 70 is at a lower enthalpy from the expansion process. The liquid from intermediate vessel 70 flows in line 72 through a second expansion device 36 to evaporator 38.

Figure 5:
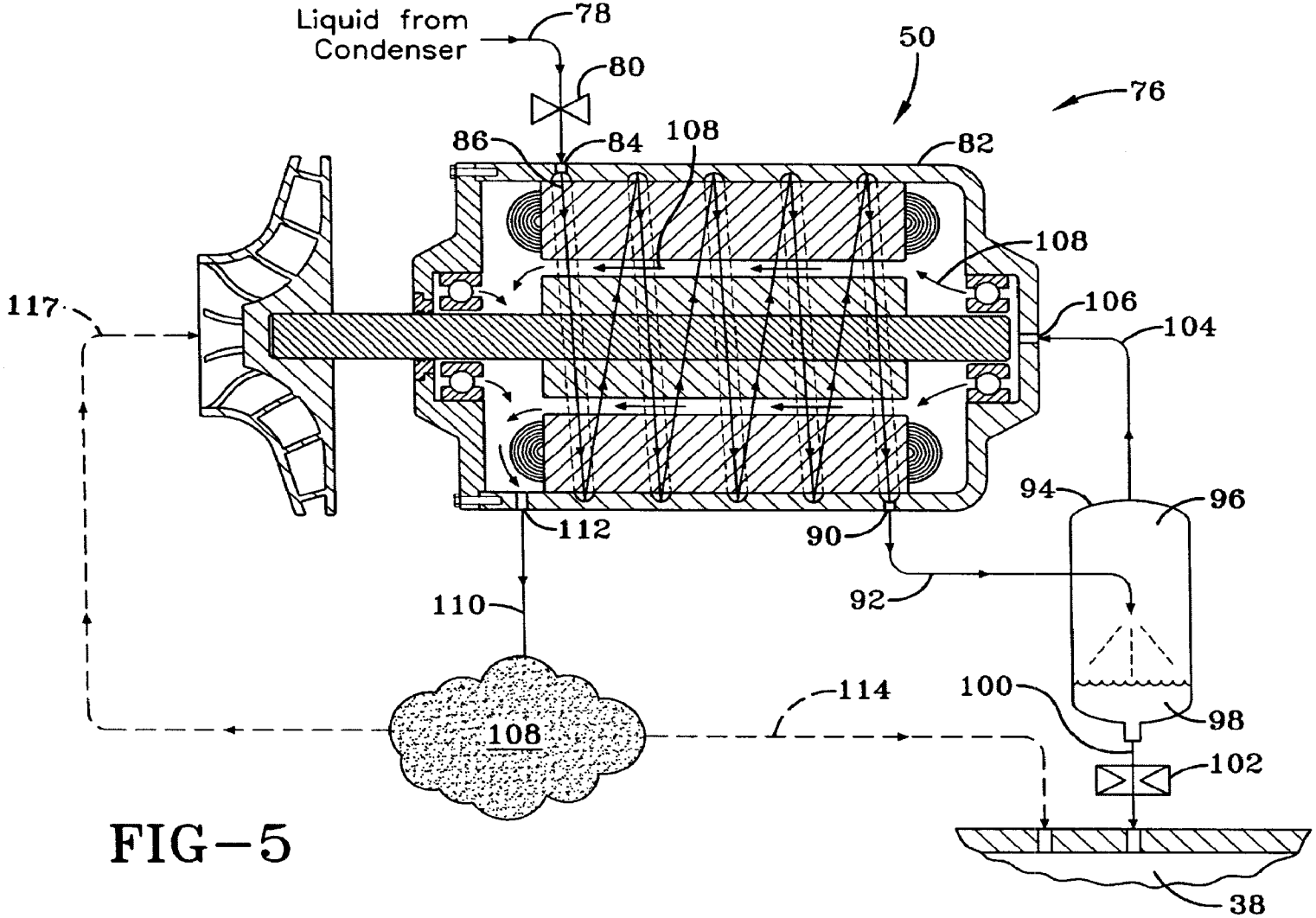
FIGS. 5-9 illustrate exemplary embodiments of motor cooling systems.

As shown in FIG. 5, cooling system 76 provides liquid cooling fluid from condenser 34 (FIG. 2) via a line 78 and then through a throttling device 80 prior to establishing a first connection 84 with a motor housing 82 of motor 50. In other embodiments, the cooling fluid received from condenser 34 is a two phase cooling fluid having a vapor phase portion and a liquid phase portion. Coil 86 located within motor housing 82 surrounds motor stator 88 (see FIG. 6) and conveys liquid from the condenser to provide cooling to the motor stator, which is a non-moving motor component with respect to motor housing 82. Due to providing cooling to the motor stator, as coil 86 extends away from first connection 84 toward a second connection 90 with motor housing 82, an amount of the liquid phase portion becomes a two phase cooling fluid, i.e., having a vapor phase portion and a liquid phase portion, as the cooling fluid is conveyed through second connection 90. Second connection 90 is in fluid communication with a line 92 which conveys the two phase cooling fluid via a conduit, such as a line 92 to a vessel 94 that separates the two phase cooling fluid into a vapor phase portion 96 and a liquid phase portion 98. Cooling fluid flowing within coil 86 between first connection 84 and second connection 90 is prevented from being circulated inside motor housing 82 to motor components that are movable with respect to the motor housing. Liquid phase portion 98 is conveyed via line 100 through a restriction 102 to evaporator 38. The vapor phase portion 96 is then conveyed from vessel 94 via line 104 to motor housing 82 by virtue of a third connection 106 between motor housing 82 and line 104. Stated another way, vapor phase portion cooling fluid conveyed through second connection 90 is in fluid communication with the vapor phase portion cooling fluid conveyed through third connection 106. Upon introduction of vapor phase portion 96 inside of motor housing 82, the vapor phase portion is then referred to as vapor phase portion 108 and provides cooling to portions of motor 50 internal to the motor, in addition to motor stator 88, such as moving motor components with respect to motor housing 82, for example, to the motor rotor 129. Once vapor phase portion 108 is circulated inside of motor housing 82 to provide cooling to the components inside of the motor housing and including moving motor components, the vapor phase portion exits or is discharged from the motor housing via a line 110 and forming a fourth connection 112 with the motor housing. Upon exiting or being discharged from motor housing 82 via line 110, vapor phase portion 108, as shown by dashed line 114 may be returned to evaporator 38 and then provided to compressor suction, or as shown by dashed line 117 the vapor phase portion may be returned directly to compressor suction, such as through passageways formed internally in the compressor housing (not shown).

Figure 6:
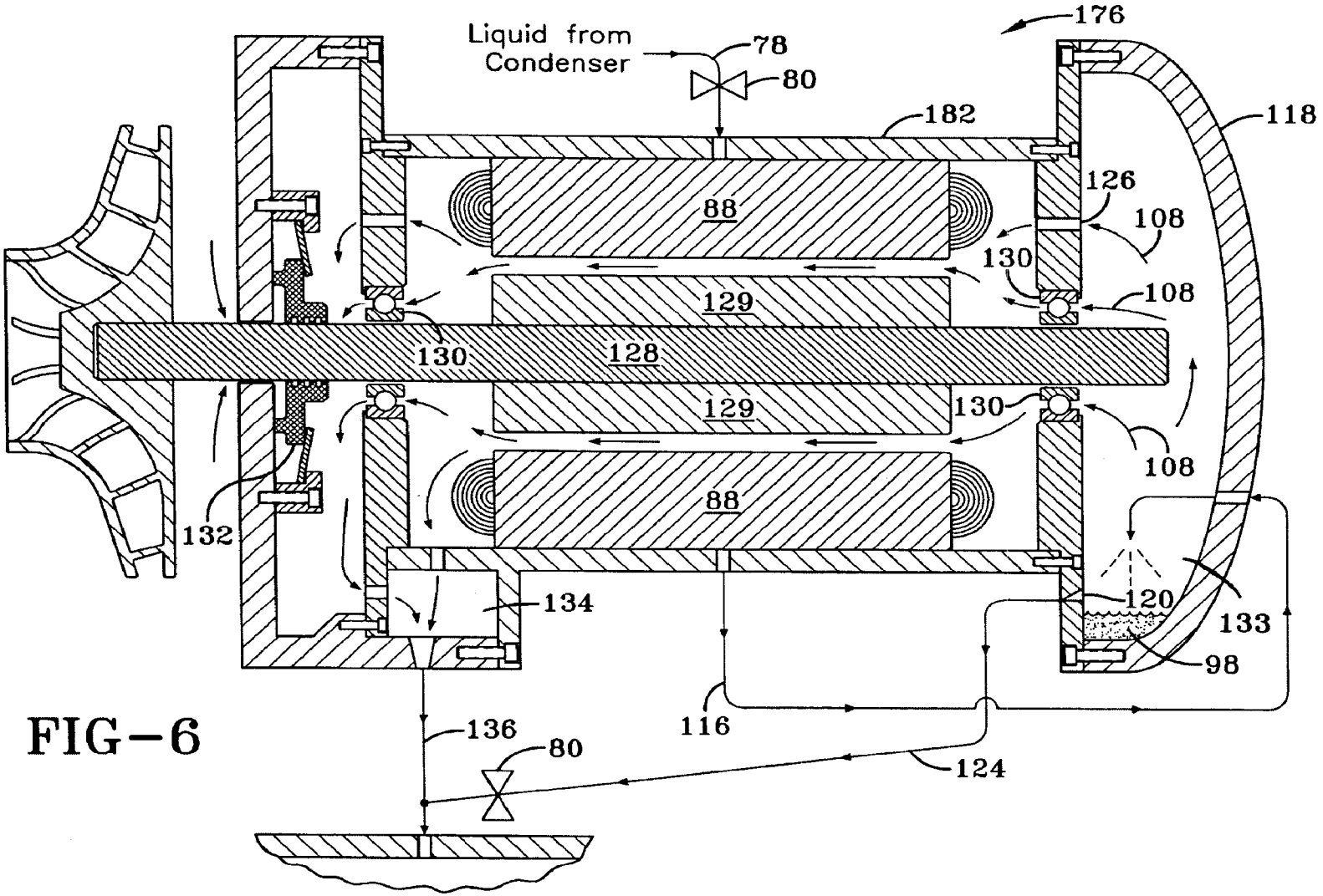

As shown in FIG. 6, an alternate cooling system 176, similar to cooling system 76, provides cooling for motor stator 88 and also circulates vapor phase portion 108 inside of motor housing 182, which is similar to motor housing 82 of FIG. 5. However, instead of two phase cooling fluid being separated in a vessel 94 exterior of motor housing 82 (FIG. 5), the two phase cooling fluid is conveyed via a line 116 and directly into motor housing 182 through a cover 118, defining a compartment 133 thereby. In other words, separation of the vapor phase portion and the liquid phase portion of the two phase cooling fluid is integrated in motor housing 182. That is, upon introduction of the two phase cooling fluid inside of motor housing 182, liquid phase portion 98 collects in a lower portion of cover 118 near an opening 120 and accumulates until the level of the liquid phase portion reaches opening 120. In one embodiment, conduit or line 116 could be at least partially, if not entirely interior of the motor housing. Upon the liquid phase portion reaching opening 120, the liquid phase portion is directed into a line 124 that extends through throttling device 80 to evaporator 38. This arrangement prevents the liquid phase portion from being circulated inside of the cavity of motor housing 182 and into contact with components rotating at high rates of speed and which could be subject to damage due to contact with the liquid phase portion. Vapor phase portion 108 is circulated inside of the cavity of motor housing 182, passing through openings 126 and spacing between shaft 128 and bearings 130, between motor rotor 129 and motor stator 88, and between other components inside of motor housing 182. Upon circulation of vapor phase portion 108 through various openings, past/between bearings and other locations within motor housing 182 to provide cooling inside of the motor housing, the vapor phase portion reaches a compartment 134 substantially opposite of cover 118 and via line 136, exits the motor housing and is conveyed to evaporator 38. In addition, compartment 134 also collects the gas leaking from the compression stage between shaft 128 and labyrinth seal 132.

Figure 7:
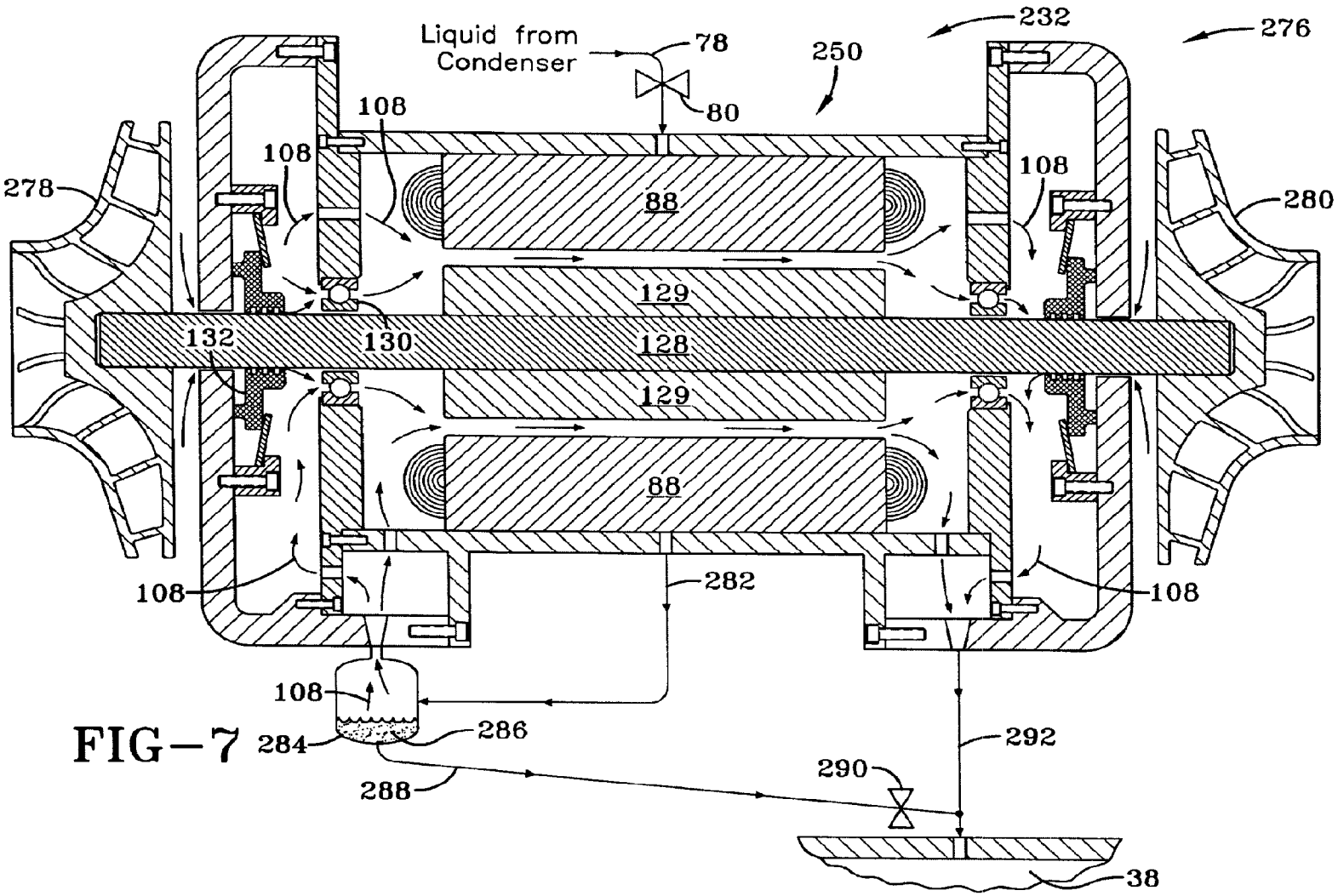

As shown in FIG. 7, which is similar to FIG. 6, cooling system 276 is associated with a motor 250 of a multiple stage compressor 232, such as a centrifugal compressor, having opposed impellers 278, 280. After cooling is provided to the motor stator 88, similar to FIG. 6, two phase cooling fluid is conveyed via a line 282 into a vessel 284 positioned exterior of motor 250 to separate the vapor phase portion 108 and the liquid phase portion 286 of the two phase cooling fluid. Liquid phase portion 286 collects in a lower portion of vessel 284 and is conveyed via a line 288 that extends through throttling device 290 and then provided to evaporator 38. Vapor phase portion 108 is provided to cool motor 250 from vessel 284 in a manner similar to that previously discussed. Vapor phase portion 108 is returned via line 292 to evaporator 38. This arrangement prevents liquid phase portion 286 from being circulated inside of the cavity of the motor housing of motor 250 and into contact with components rotating at high rates of speed and which could be subject to damage due to contact with the liquid phase portion.

Figure 8A:
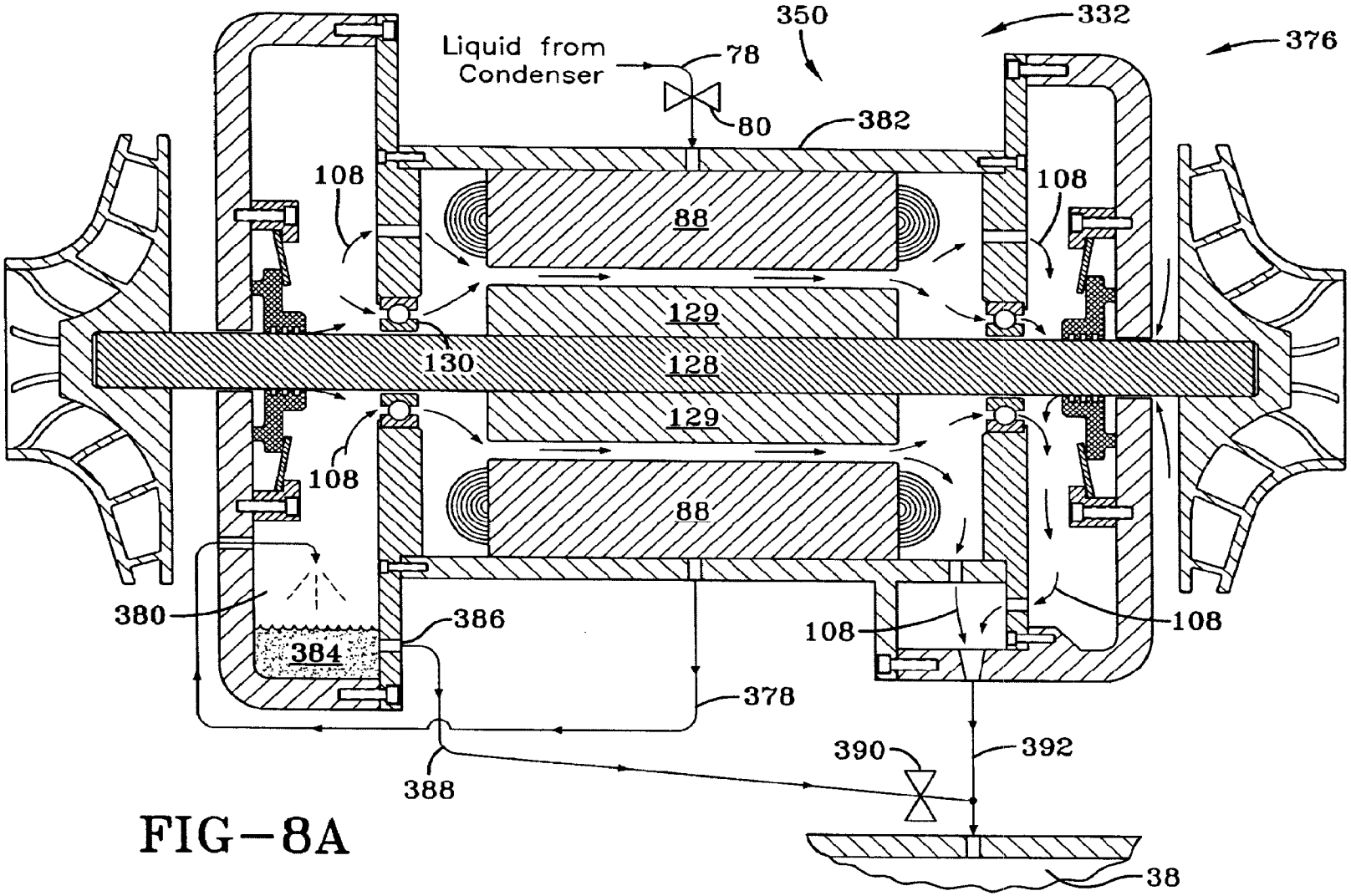

As shown FIG. 8A, cooling system 376 includes features from each of FIGS. 6-7. That is, cooling system 376 is shown associated with a motor 350 of a multiple stage compressor 332, such as shown in FIG. 7. After cooling is provided to the motor stator 88 as previously discussed, the two phase cooling fluid is conveyed via a line 378 and directly into a compartment 380 of motor housing 382 having a connection, i.e., an opening 386, with line 388 that is positioned at or near the bottom of the compartment. In other words, separation of the vapor phase portion and the liquid phase portion of the two phase cooling fluid is integrated in motor housing 382. That is, upon introduction of the two phase cooling fluid inside of motor housing 382, liquid phase portion 384 collects in a lower portion of compartment 380 and drains to an opening 386. From there, the liquid phase portion is directed exterior of motor housing 382 via a line 388 that extends through throttling device 390 to evaporator 38. Vapor phase portion 108 is provided to cool motor 350 in a manner similar to that previously discussed. Vapor phase portion 108 is returned via line 392 to evaporator 38.

Figure 8B:
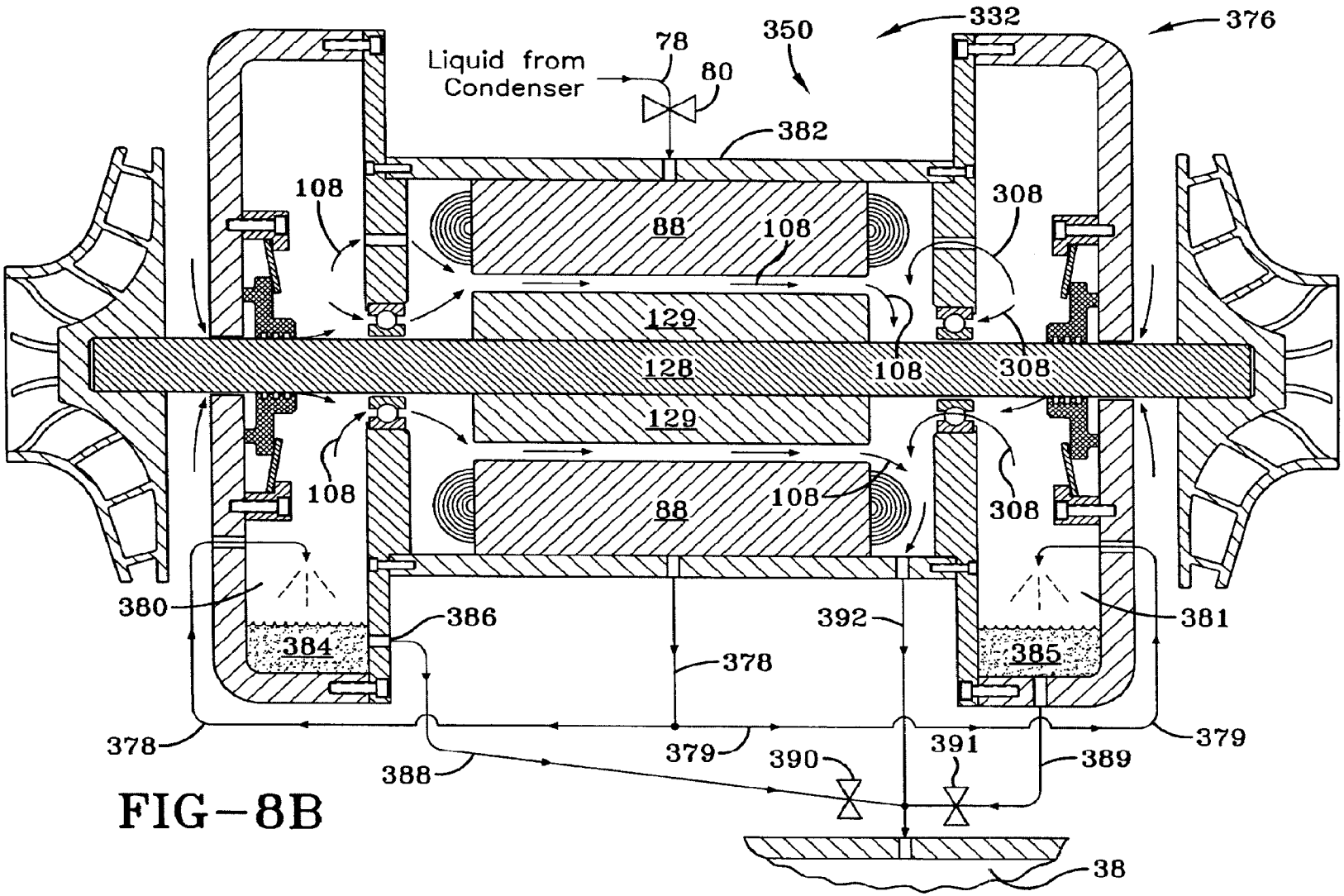

FIG. 8B is an alternate embodiment of FIG. 8A. However, as further shown in FIG. 8B, while cooling is provided to the motor stator 88 as previously discussed in FIG. 8A, the two phase cooling fluid conveyed via line 378 is bifurcated, with the bifurcated portion of the line designated as line 379. Line 378 extends directly into compartment 380 of motor housing 382, with line 388 that is positioned at or near the bottom of the compartment and extending exterior of the motor housing and through throttling device 390 as previously discussed. Similarly, line 379 extends directly into a compartment 381 of motor housing 382 in which liquid phase portion 385 is collected and separated from vapor phase portion 308. Liquid phase portions 108, 308 are directed exterior of motor housing 382 via a line 389 that extends through a throttling device 391 to evaporator 38. As shown in FIG. 8B, vapor phase portion 308 is provided to cool the bearings located in the right hand side of motor housing 382 prior to return via line 392 to evaporator 38. Vapor phase portion 108, which has a greater pressure than vapor phase portion 308, such as due to different settings between throttling devices 390 and 391, flows through the right hand portions of motor housing 382, between motor stator 88 and motor rotor 129, prior to exiting the motor housing 382 via line 392. In a further embodiment, the pressure level associated with vapor phase portion 108 can be greater than the pressure level of vapor phase portion 308. Vapor phase portion 308 may also provide additional cooling to portions of the motor housing located in the right hand side of the motor housing, such as the bearings. Due to bifurcation of line 378 to provide cooling fluid to different compartments or portions of the motor housing, increased motor cooling may be achieved, which is especially beneficial in applications such as heat pumps.

Figure 9:
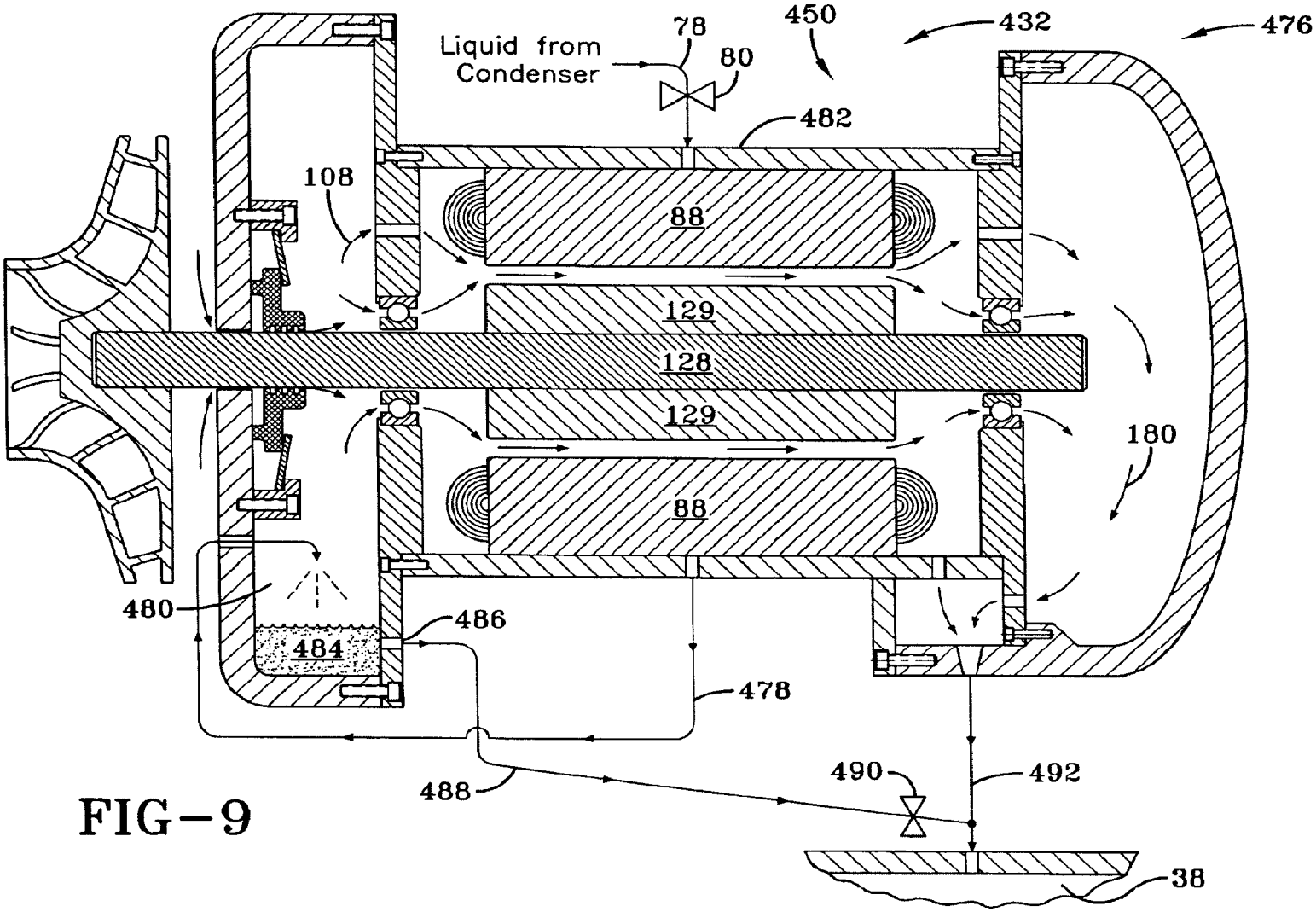

As shown in FIG. 9, cooling system 476 is similar to cooling system 176 of FIG. 6. That is, cooling system 476 is shown associated with a motor 450 of a single stage compressor 432, such as shown in FIG. 6. After cooling is provided to the motor stator 88 as previously discussed, the two phase cooling fluid is conveyed via a line 478 and directly into a compartment 480 of motor housing 482. In other words, separation of the vapor phase portion and the liquid phase portion of the two phase cooling fluid is integrated in motor housing 482. That is, upon introduction of the two phase cooling fluid inside of motor housing 482, liquid phase portion 484 collects in a lower portion of compartment 480 near an opening 486 and accumulates until the level of the liquid phase portion 484 reaches opening 486. Upon the liquid phase portion reaching opening 486, the liquid phase portion is directed exterior of motor housing 482 via a line 488 that extends through throttling device 490 to evaporator 38. Vapor phase portion 108 is provided to cool motor 450 in a manner similar to that previously discussed. Vapor phase portion 108 is returned via line 492 to evaporator 38.

While only certain features and embodiments of the invention have been shown and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A cooling system provided for a motor powering a compressor in a vapor compression system further comprising a condenser and an evaporator, the cooling system comprising:

a housing enclosing the motor;

a cavity located within the housing;

a fluid circuit having a first connection with the housing configured to provide a liquid or two phase cooling fluid from the condenser to the motor, the two phase cooling fluid being separable into a vapor phase portion and a liquid phase portion, the fluid circuit further having a second connection with the housing to remove cooling fluid in fluid communication with the fluid circuit, cooling fluid flowing from the first connection to the second connection being prevented from being circulated inside the housing to the motor components that are movable with respect to the housing, the cooling fluid conveyed through the second connection being two phase cooling fluid, the fluid circuit further having a third connection with the housing for receiving and circulating in the cavity the vapor phase portion conveyed through the second connection; and a conduit positioned between the second connection and the third connection for conveying two phase cooling fluid therebetween;

wherein the conduit includes a vessel positioned upstream of the evaporator for separating the liquid phase portion from the vapor phase portion exiting the housing from the second connection, the only inlet path leading cooling fluid to the vessel being that extending from the second connection with the housing to the vessel;

wherein the vessel defines a compartment for separating the liquid phase portion from the vapor phase portion exiting the housing from the second connection;

wherein the compartment is positioned interior of the housing.

2. The system of claim 1, wherein the system includes a throttling device positioned near the first connection.

3. The system of claim 2, wherein the throttling device is positioned between a condenser of the vapor compression system and the first connection.

4. The system of claim 1, wherein a portion of the fluid circuit between the first connection and the second connection is associated with providing cooling to the motor stator.

5. The system of claim 1, including a fourth connection with the housing for discharging the vapor phase portion received from the third connection.

6. The system of claim 1, wherein the vessel is positioned exterior of the housing.

7. The system of claim 1, wherein the vessel separates the liquid phase portion from the vapor phase portion of the two phase cooling fluid prior to the vapor phase portion being conveyed through the third connection.

8. The system of claim 1, wherein the compartment separates the liquid phase portion from the vapor phase portion of the two phase cooling fluid prior to the vapor phase portion being conveyed through the third connection.

9. The system of claim 1, wherein the compressor is a multiple stage compressor.

10. A method for cooling a motor powering a compressor in a vapor compression system further comprising a condenser and an evaporator, comprising:

providing a housing enclosing the motor;

providing a cavity located within the housing;

providing a fluid circuit having a first connection with the housing configured to provide cooling fluid from the condenser to the motor, the fluid circuit further having a second connection with the housing to remove cooling fluid in fluid communication with the fluid circuit, the fluid circuit further having a third connection with the housing for receiving cooling fluid in the cavity conveyed through the second connection;

providing a conduit positioned between the second connection and the third connection for conveying two phase cooling fluid therebetween;

wherein the conduit includes a vessel positioned upstream of the evaporator for separating the liquid phase portion from the vapor phase portion exiting the housing from the second connection, the vessel only receiving cooling fluid from the second connection with the housing;

separating cooling fluid flowing between the first connection and the second connection into a vapor phase portion and a liquid phase portion, the cooling fluid flowing between the first connection and the second connection being prevented from being circulated inside the housing to components movable with respect to the housing; and circulating in the cavity the vapor phase portion conveyed through the third connection.

11. The method of claim 10, wherein the vessel defines a compartment for separating the liquid phase portion from the vapor phase portion exiting the housing from the second connection, the compartment positioned interior or exterior of the housing.

* * * * *